US006357365B1

(12) United States Patent
Higgins et al.

(10) Patent No.: US 6,357,365 B1
(45) Date of Patent: Mar. 19, 2002

(54) INTERMEDIATE BULK CONTAINER LIFTING RACK

(75) Inventors: Scott Higgins, Beatrice, NE (US); William Terry, Sulphur, LA (US)

(73) Assignee: Hoover Group, Inc., Alpharetta, GA (US)

( * ) Notice: Subject to any disclaimer, the term of this patent is extended or adjusted under 35 U.S.C. 154(b) by 0 days.

(21) Appl. No.: 09/443,615

(22) Filed: Nov. 18, 1999

(51) Int. Cl.[7] ..... B65D 19/44
(52) U.S. Cl. ..... 108/55.1
(58) Field of Search ..... 108/55.1, 55.3, 108/57.22, 57.23, 57.24, 57.31, 57.32, 51.11

(56) References Cited

U.S. PATENT DOCUMENTS 4,295,431 A * 10/1981 Stavlo ..... 108/55.1
5,228,821 A * 7/1993 Gleffe et al. ..... 108/55.1 X
5,507,237 A * 4/1996 Barrow et al. ..... 108/55.1
5,609,111 A * 3/1997 Hasegawa et al. ..... 108/55.1
5,657,887 A * 8/1997 Smith ..... 108/55.1 X
5,676,066 A * 10/1997 Cavalier et al. ..... 108/55.1
5,833,289 A * 11/1998 Brolin ..... 108/55.1 X

FOREIGN PATENT DOCUMENTS

DE 2460846 * 7/1976 ..... 108/55.1

* cited by examiner

*Primary Examiner*—Jose V. Chen
(74) *Attorney, Agent, or Firm*—Wood, Phillips, VanSanten, Clark & Mortimer

(57) ABSTRACT

A lifting rack comprises abase including opposite longitudinal rails connected between plural laterally-extending rails to define a support surface having plural rectangular support areas each to support an IBC, in use. A frame is secured to and extends upwardly from the base. The frame includes plural posts secured to the rails proximate outside corners of each of the rectangular support areas. A pair of longitudinal bars and lateral bars are secured to one another at each corner, in a rectangular configuration, and secured to tops of the posts. Lifting lugs or forklift runners are provided for engagement by a transport device for lifting the rack.

27 Claims, 10 Drawing Sheets

INTERMEDIATE BULK CONTAINER LIFTING RACK

FIELD OF THE INVENTION

This invention relates to transport and storage of bulk goods and more particularly, to a lifting rack for intermediate bulk containers.

BACKGROUND OF THE INVENTION

Bulk packaging containers have found widespread use for storage and shipment of bulk goods. The bulk packaging containers assume many different forms. Among these forms are intermediate bulk containers (IBC). Requirements for these types of containers are outlined in various D. O. T. and F. D. A. regulations and are particularly defined in 47CFR Section 171.8.

Among IBCs, there include numerous types of designs. These include metal IBCs, which are constructed of metal, rigid plastic IBCs which are constructed of all-plastic material, and composite IBCs which include a rigid outer package enclosing a plastic inner receptacle.

An IBC typically has a capacity in the range of 250–550 gallons. As such, they are an efficient alternative to 55-gallon drums. Nevertheless, each IBC must be handled and transported individually when used, for example, in the export of materials. The IBC is typically loaded into a shipping vessel. Each IBC must be individually slung by a crane or carried by a forklift during the loading and unloading.

The present invention is directed to improvements in the transport and storage of bulk materials.

SUMMARY OF THE INVENTION

In accordance with the invention there is disclosed a lifting rack for supporting plural intermediate bulk containers (IBCs).

Broadly, there is disclosed a lifting rack comprising a base including opposite longitudinal rails connected between plural laterally-extending rails to define a support surface having plural rectangular support areas each to support an IBC, in use. A frame is secured to and extends upwardly from the base. The frame includes plural posts secured to the rails proximate outside corners of each of the rectangular support areas. A pair of longitudinal bars and lateral bars are secured to one another at each corner, in a rectangular configuration, and secured to tops of the posts. Lifting means are provided for engagement by a transport device for lifting the rack.

It is a feature of the invention that the lifting means comprises plural lifting lugs secured to the bars proximate each corner.

It is another feature of the invention that the lifting means comprises runners secured to an underside of the base to define a space for lifting with a forklift.

It is a further feature of the invention that the rails comprise I-beam rails.

It is another feature of the invention that the base includes a planar pad secured to the rails proximate each corner of the rectangular support areas.

It is a further feature of the invention that the base includes an L-bracket secured to and extending upwardly from the rails proximate each corner of the rectangular support areas.

It is still another feature of the invention that the bars comprise tubular bars and the posts comprise tubular posts.

It is still a further feature of the invention to provide means for removably securing an IBC on each of the rectangular support areas, in use. The removably securing means comprises an elongate rod passing through openings in opposite plates secured to the frame.

It is an additional feature of the invention to provide a manifold received in the base for connecting to plural IBCs, in use. The manifold includes a quick coupler for each rectangular support area and an outlet valve.

There is disclosure in accordance with another aspect of the invention a lifting rack comprising a steel base including three longitudinal rails connecting three laterally-extending rails to define a support surface having four rectangular support areas each to support an IBC, in use. A steel frame is secured to and extends upwardly from the base. The frame includes four corner posts and two central posts secured to the rails proximate outside corners of each of the rectangular support areas. A pair of longitudinal bars and lateral bars are secured to one another at each corner, in a rectangular configuration, and secured to tops of the posts. Lifting means are provided for engagement by a transport device for lifting the rack.

More particularly, the lifting rack is compartmentalized to receive up to four IBCs. Thus, the IBCs are unitized as one unit capable of fluid handling in the range of 1100 to 2200 gallons. The lifting rack can be lifted using either a forklift or a crane. Side entry is provided for IBC loading as well as top loading. The lifting rack can be used to handle four separate liquid products at up to 550 gallons each. Each IBC can be pumped separate from the others. A single manifold unit is used that is protected underneath the lifting rack. All of the piping utilizes stainless steel. The IBCs are equipped with quick couplings for quick connection to the manifold. The individual IBCs can be removed or replaced for individual cleaning and filling.

Further features and advantages of the invention will be readily apparent from the specifications and from the drawings.

DETAILED DESCRIPTION OF THE INVENTION

Figure 1:
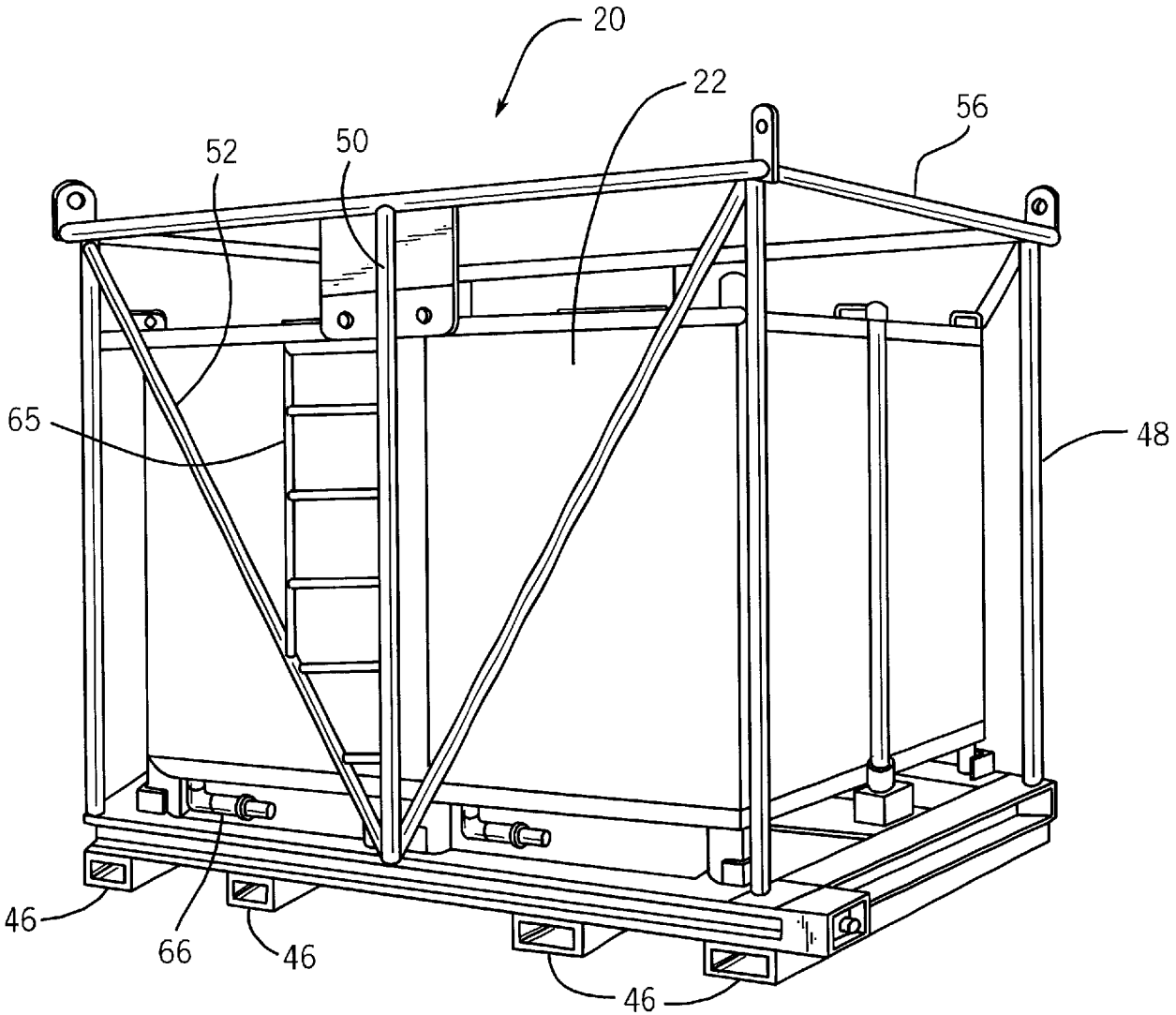
FIG. 1 is a perspective view of a lifting rack according to the invention supporting plural intermediate bulk containers (IBCs), in use.

Referring to FIG. 1, a lifting rack 20 is illustrated for supporting up to four portable tanks in the form of intermediate bulk containers (IBCs) 22 for transporting and storing materials, such as liquid materials.

The present invention relates particularly to the structure of the lifting rack 20. In the illustrated embodiment of the invention, the lifting rack 20 is shown supporting an intermediate bulk container manufactured and sold by the assignee of the present invention under the trademark LIQUITOTE. The LIQUITOTE® IBC is a steel container providing capacity in the range of 255 to 550 gallons and has a nominal width of 42 inches and nominal length of either 42 or 48 inches. The capacity is otherwise determined by height of the container, which is variable. Although the lifting rack 20 is illustrated supporting the LIQUITOTE ® IBC, the lifting rack 20 could be used for supporting other types of IBCs, portable tanks, or the like, as will be apparent skilled in the art. As used herein, the term intermediate bulk container is intended to also refer more generally to portable tanks, as is known in the art.

Figure 2:
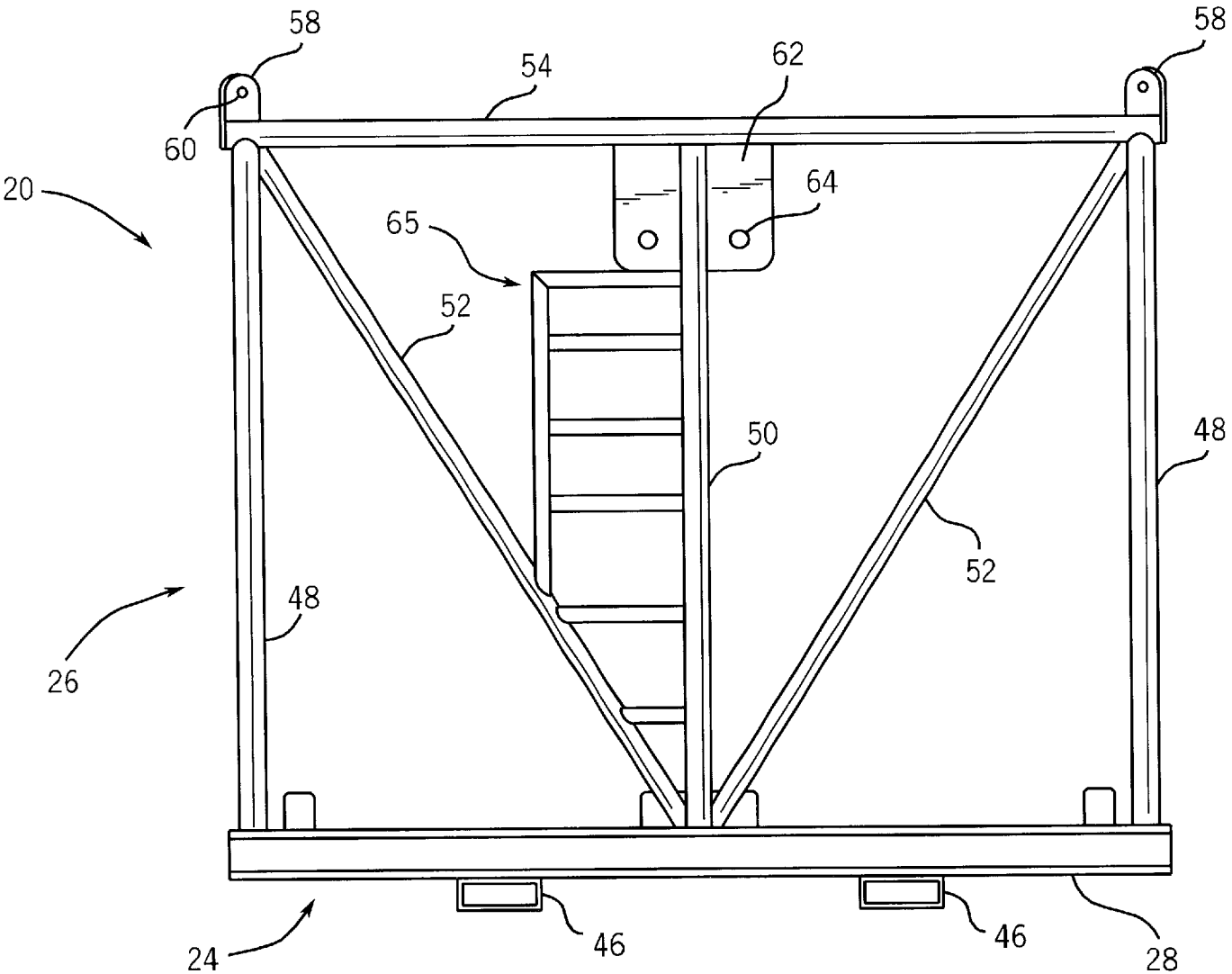
FIG. 2 is a front view of the lifting rack of FIG. 1, illustrated without IBCs.
Figure 3:
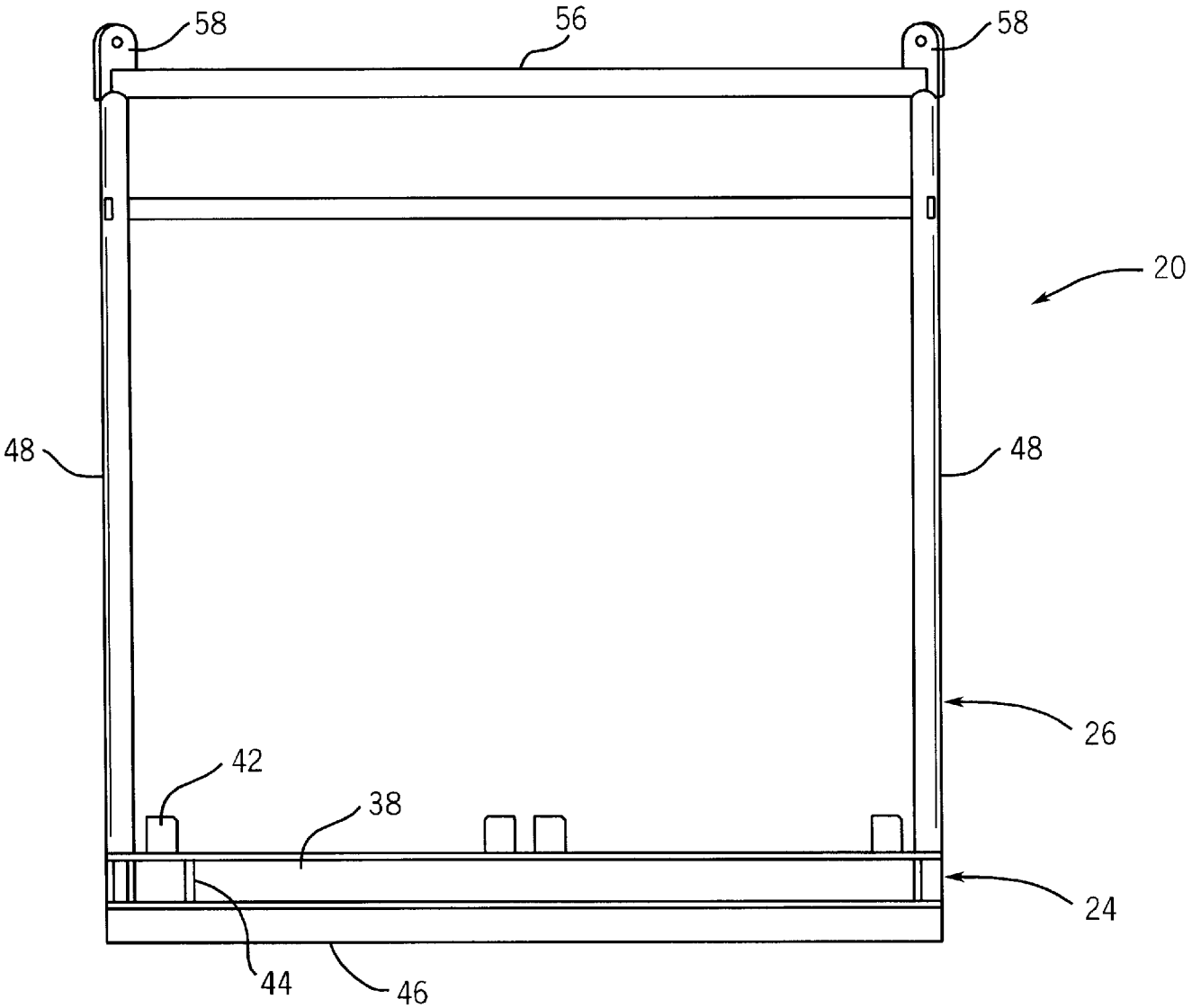
FIG. 3 is a side view of the lifting rack of FIG. 2.
Figure 4:
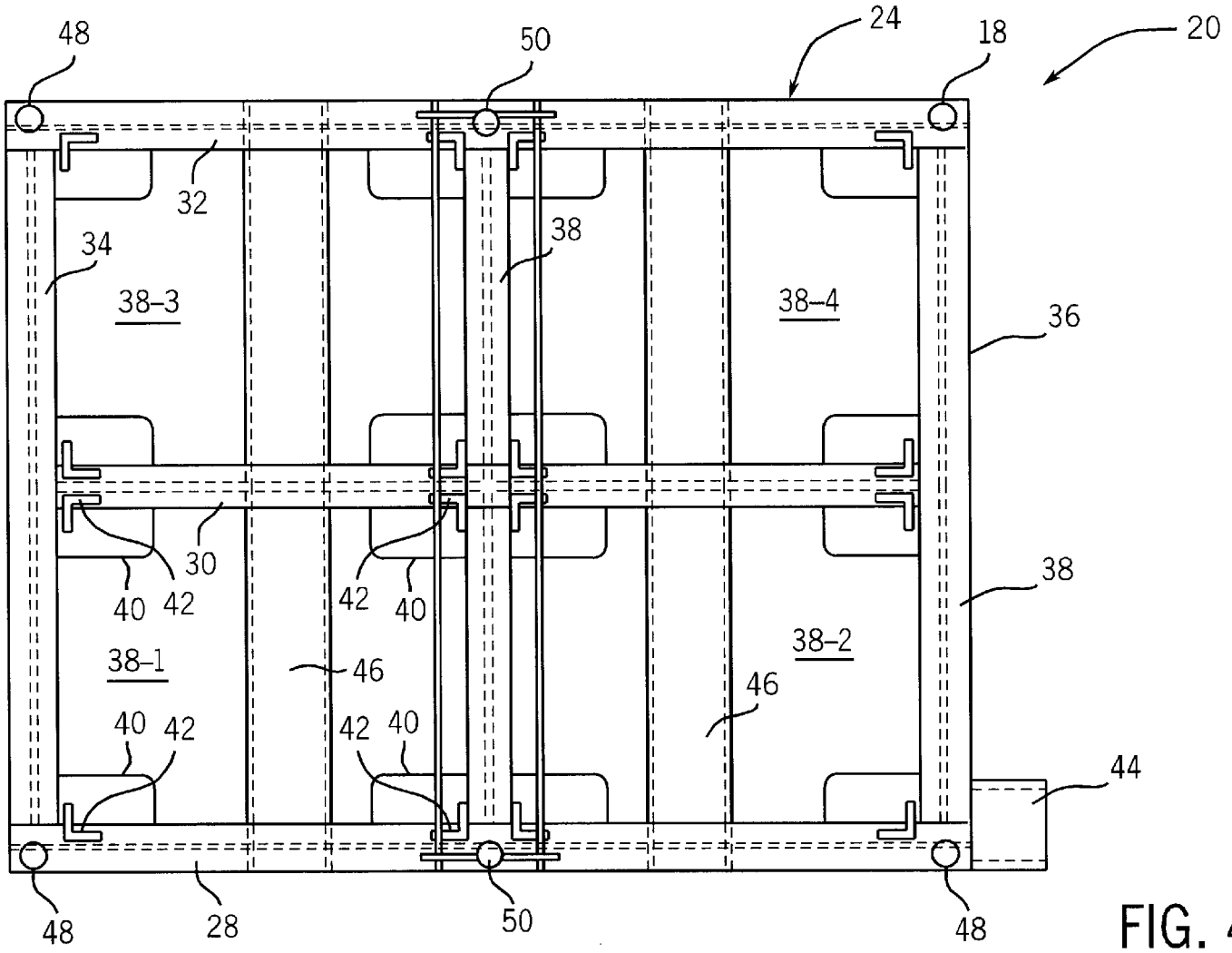
FIG. 4 is a top plan view of the lifting rack of FIG. 2, shown without a top portion of a frame for clarity.

Referring to FIGS. 2–4, the lifting rack 20 generally comprises a steel base 24 and a steel frame 26. Referring particularly to FIG. 4, the base 24 is generally rectangular and comprises a front longitudinal rail 28, a central longitudinal rail 30 and a rear longitudinal rail 32. Opposite side transverse rail 34 and 36 extend between the front rail 28 and the rear rail 32 at opposite ends thereof A two-piece central lateral rail 38 extends transversely between the front rail 28, the central longitudinal rail 30, and the rear rail 32. The central lateral rail 38 is located mid-way between the side end rails 34 and 36. The central longitudinal rail 30 is positioned centrally between the front longitudinal rail 28 and the rear longitudinal rail 32.

In accordance with the invention, the rails 28, 30, 32, 34, 36 and 38 are in the form of steel I-beams which are W6×20#. The rails of the base 24 define a support surface 38 for supporting the IBCs 22. Particularly, the support surface has four rectangular support areas 38-1, 38-2, 38-3 and 38-4, referred to generically herein as 38-x, each to support an IBC 22, in use.

A planar support pad 40 is secured to the base 24 at a comer of each rectangular support area 38-x. Each planar pad 40 is approximately 6 inches wide and 12 inches long and approximately ½ inch thick. The pads 40 are connected as by welding to the rails which define the corners of the support areas 38-x. For example, in the lower leftmost comer of FIG. 4, the planar pad 40 is welded to the front longitudinal rail 28 and the side transverse rail 34. The pads 40 are flush with the rails to form part of the support surface 38.

A right-angle, or L-bracket, 42 is secured to and extends upwardly from the base 24, also at each comer of each rectangular support area 38-x. The brackets 42 are approximately 4 inches by 4 inches by ⅜ inch thick and are welded to one of the longitudinal rails 28, 30 or 32 and a pad 40.

The pads 40 are positioned to support feet 44 of the IBC 22, in use. Likewise, spacing between the brackets 42 at opposite corners is determined so that the four feet 43 of an IBC 22 are nested within the brackets 42 to prevent lateral or longitudinal movement of the IBC 22 during transportation.

A downwardly-opening, U-shaped valve guard 44 extends longitudinally from the base 24 at a corner defined by the intersection of the front longitudinal rail 28 and the side transverse rail 38. In the embodiment of FIGS. 2–4, a pair of longitudinally-spaced runners 46 extends transversely on the underside of the base 24. The runners 46 are of tubular steel construction and are approximately 4-inch high by 10-inch wide, by ½ inch thick. The runners space the base 24 off of a ground surface to enable the rack 20 to be lifted by a forklift.

In FIG. 1 illustrates the lifting rack 20 including four runners 46, rather than two as shown in FIGS. 2–4.

The frame 26 comprises four corner posts 48 and two central posts 50. The posts 48 and 50 are 3-inch pipes constructed of S/80 steel. The corner posts 48 are secured as by welding at opposite ends of the front longitudinal rail 28 and the rear longitudinal rail 32. The central posts 50 are likewise secured as by welding to the front and rear rails 28 and 32, respectively, centrally located between the corner posts 48. Diagonally-extending braces 52 extend downwardly from each of the corner posts 48 to an adjacent central post 50, as shown in FIG. 2. The braces comprise 2-inch S/80 steel pipe. A pair of longitudinal bars 54 are secured as by welding to tops of the corner posts 48 and central posts 50. A pair of lateral bars 56 are also secured as by welding in between tops of the corner posts 48 and likewise are secured as by welding to the longitudinal bars 54 in a rectangular configuration, as shown in FIG. 1. The bars 54 and 56 are 3-inch pipes of S/80 steel. A lifting lug 58 is secured as by welding at the top each of the corner posts 48 and to the corresponding longitudinal bars 54 and lateral bars 56. Each of the lifting lugs includes a 1-inch opening 60. The lifting lugs can be used for lifting of the rack 20 via a crane or the like.

Four rectangular plates 62 are secured as by welding to the frame 26. Each plate 62 is approximately 9 inches wide by 16 inches high, by ½-inch thick. Each plate 62 is located proximate an intersection of one of the central posts 50 and the longitudinally-extending bars 54. Each plate 62 includes an opening 64.

A ladder 65, formed of S/80 steel pipe, is integrally secured as by welding between the central post 50 and the left-most brace 52 on the front side of the frame 26. The ladder 65 provides easy access to the top of the IBC's 22 for venting and for hook-up to the lifting lugs 58.

Figure 5:
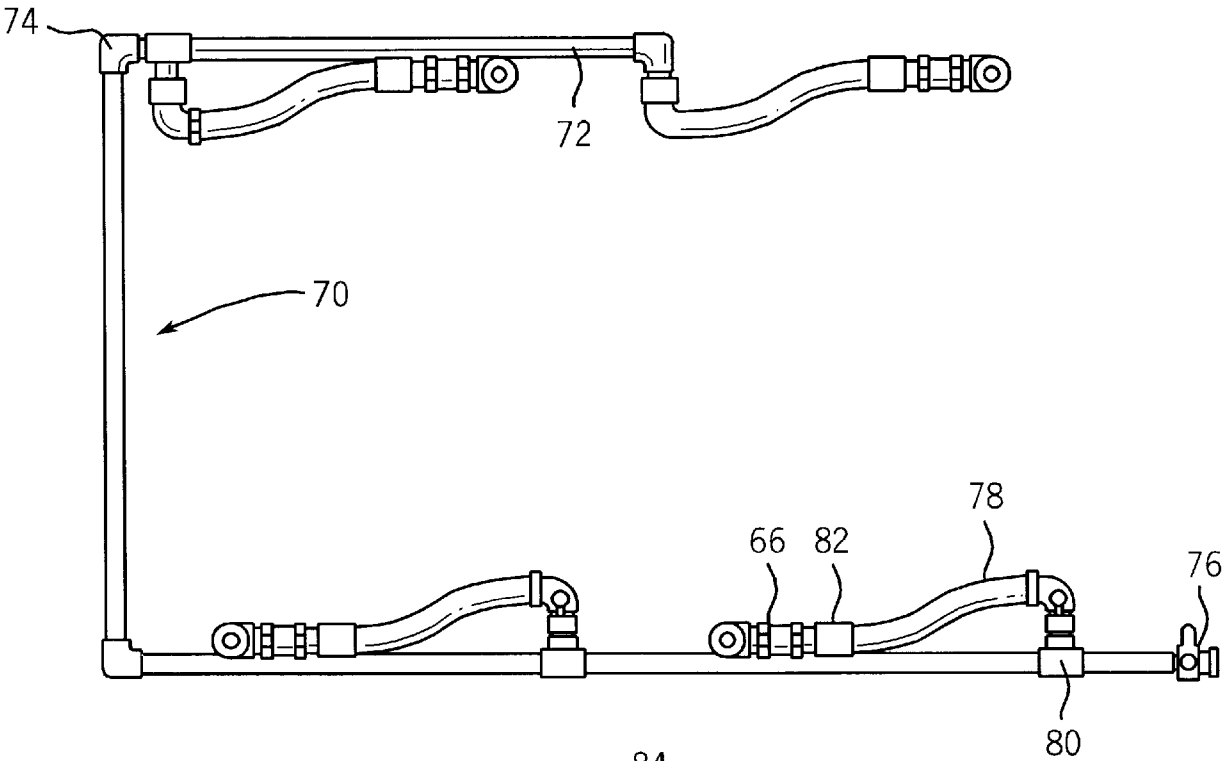
FIG. 5 is a top plan view of a manifold used with the lifting rack of FIG. 2.
Figure 11:
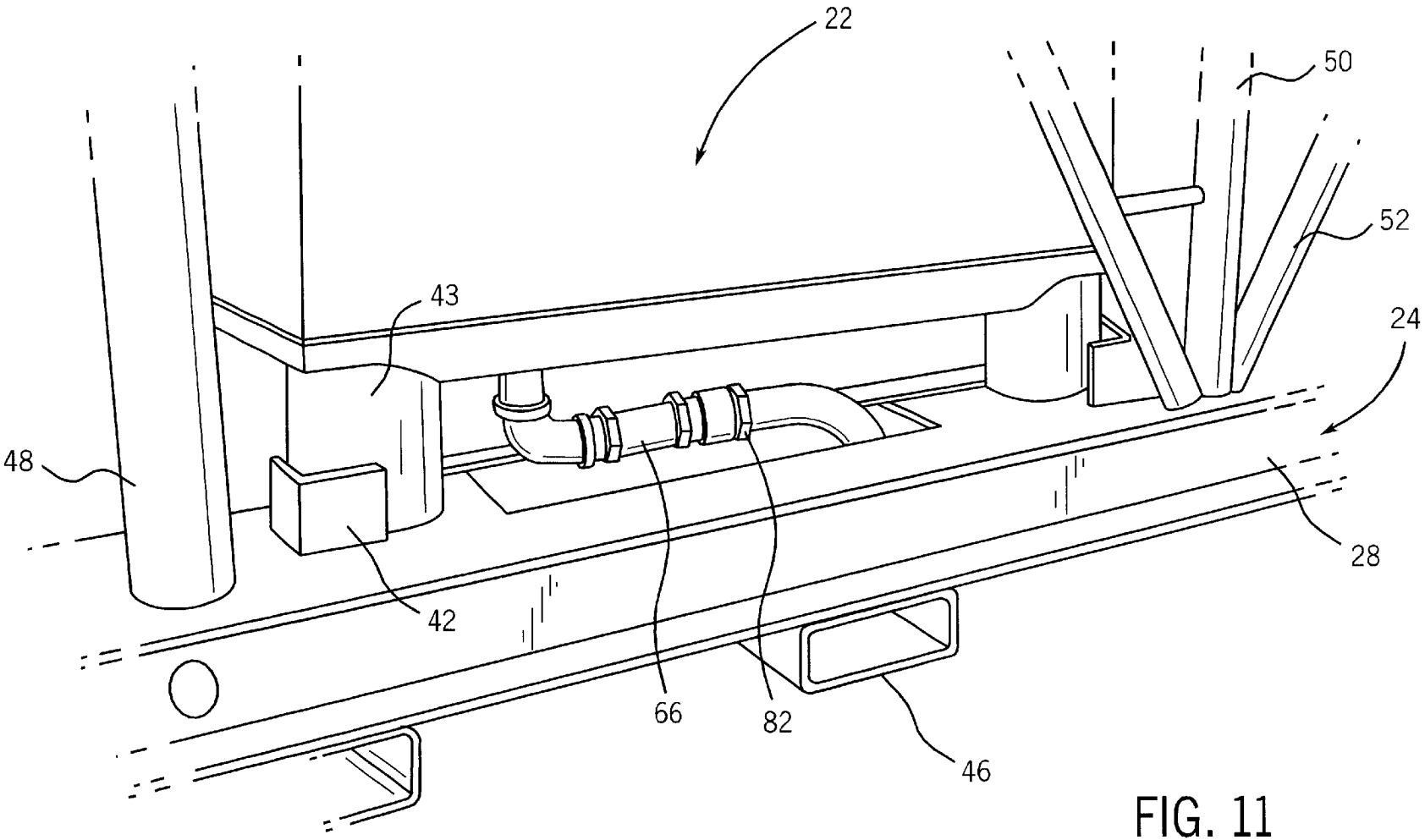
FIG. 11 is a detailed view illustrating coupling of an IBC in the lifting rack to the manifold.

An IBC, such as the IBC 22 typically includes a discharge valve 66, see FIGS. 1 and 11. To facilitate removal of liquid from the IBCs, the lifting rack 20 utilizes a manifold 70 as shown in FIG. 5. The manifold 50 consists of 2-inch PVC pipe 72 formed using elbows 74 in a "Jr" configuration. Alternatively, the manifold 50 could use steel or stainless steel pipe. A 2-inch plastic valve 76 is included at one end of the pipe 72. A liquid transfer hose assembly 78 is connected to the pipe 72 using a tee 80 at four locations. A 2-inch quick disconnect male adaptor 82 is provided at the end of each hose assembly 78.

Figure 6:
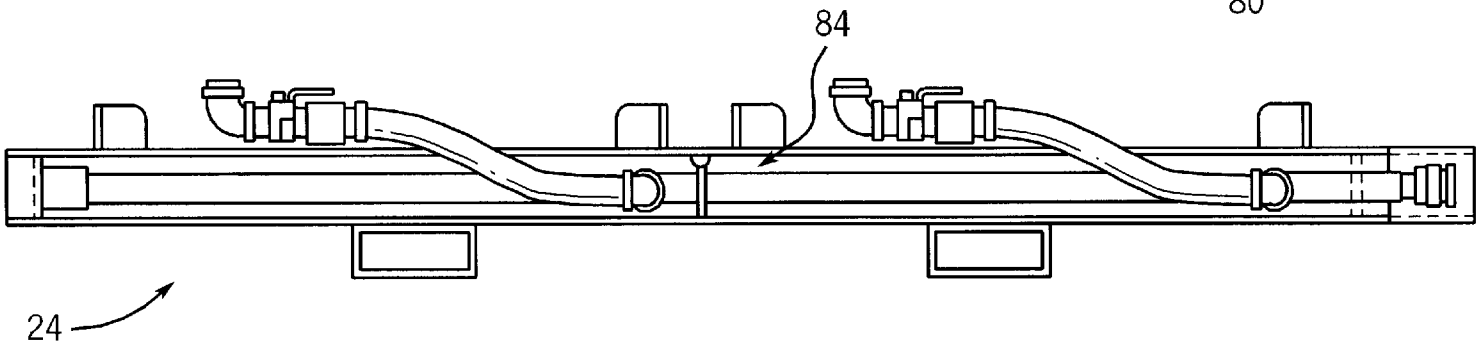
FIG. 6 is a side, partial elevation view showing the manifold of FIG. 5 mounted in a base of the lifting rack of FIG. 2.
Figure 7:
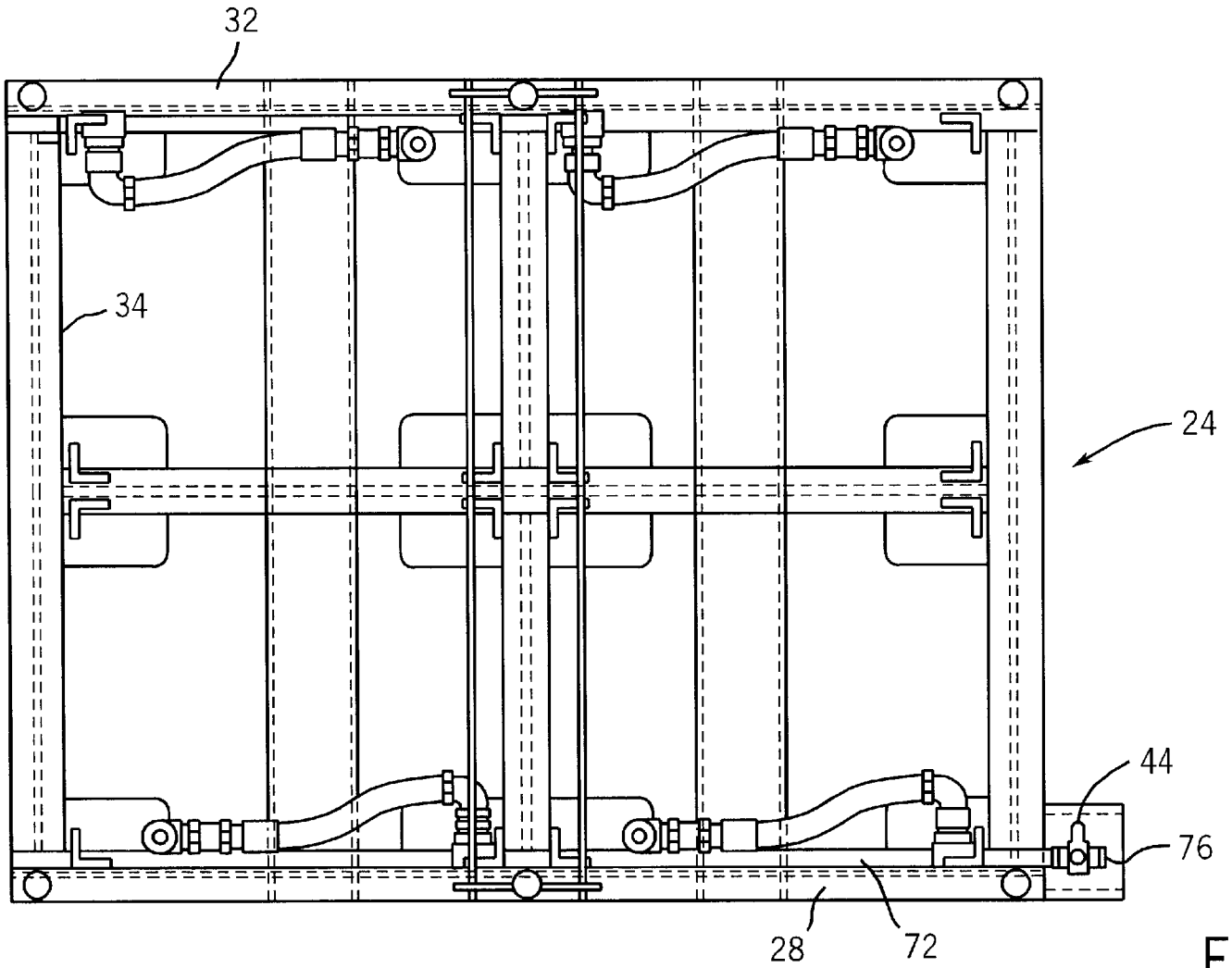
FIG. 7 is a top plan view, similar to FIG. 4, showing the manifold in the lifting rack.
Figure 8:
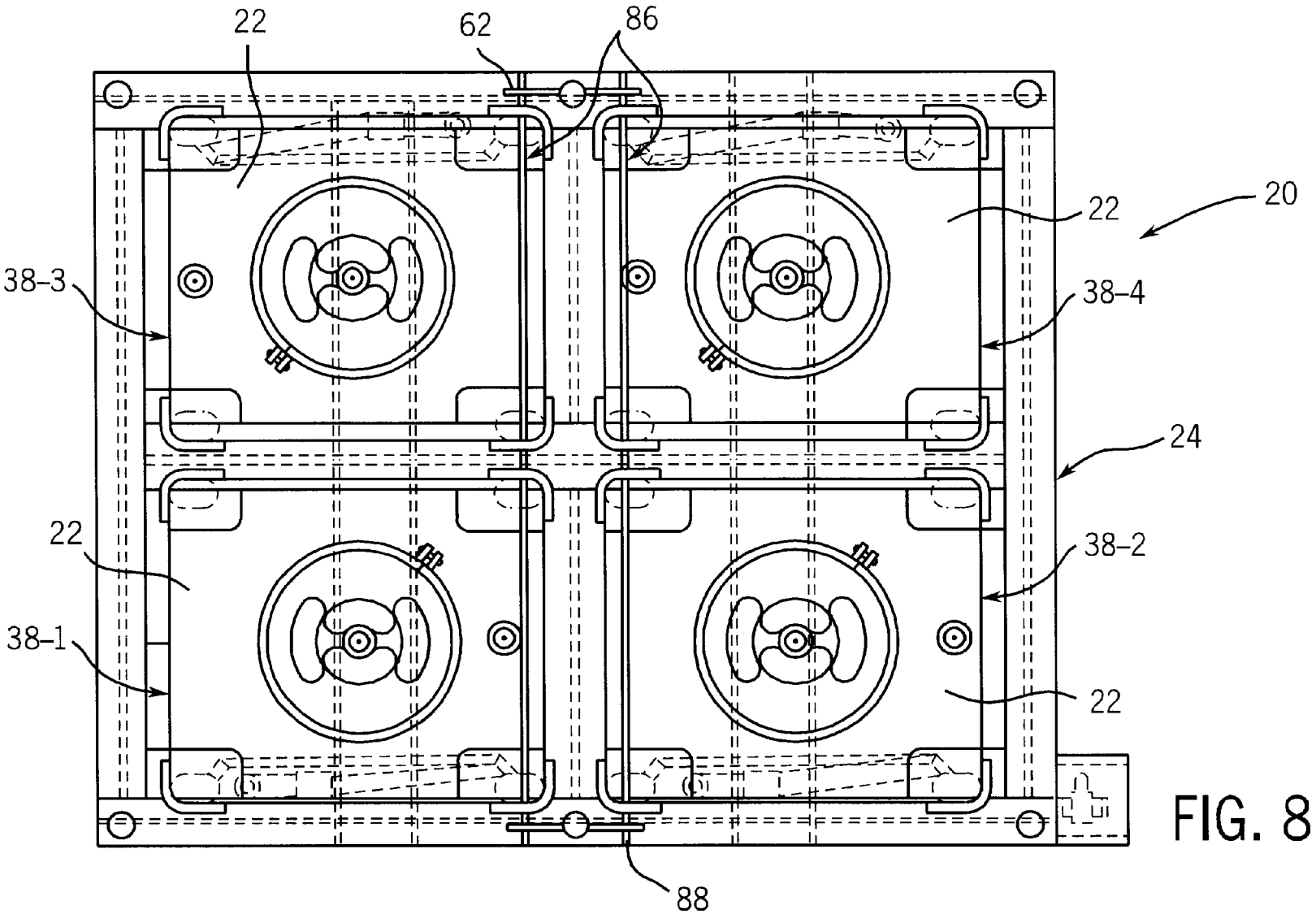
FIG. 8 is a top plan view, similar to FIG. 4, illustrating the lifting rack supporting four IBCs.
Figure 9:
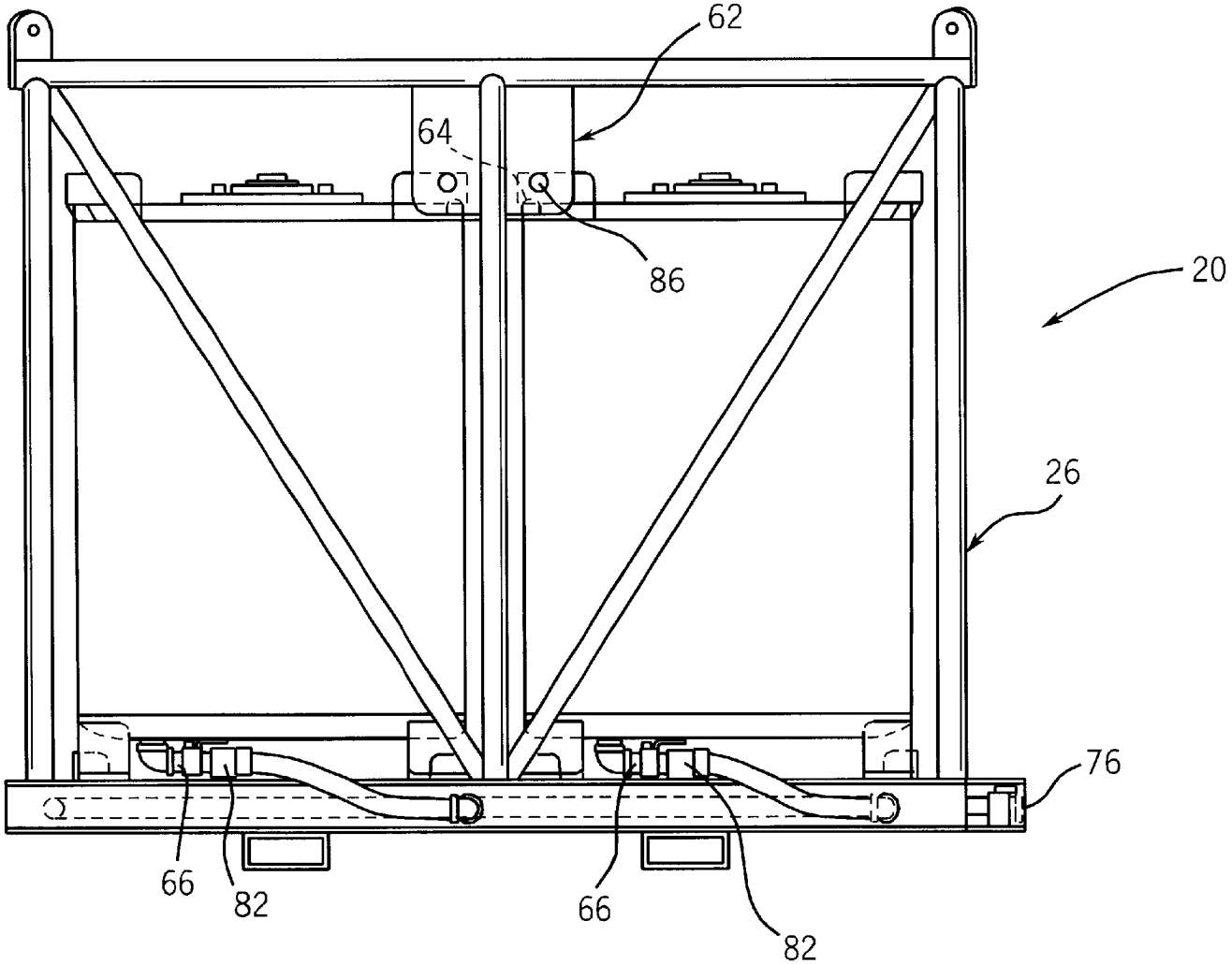
FIG. 9 is a front elevation view of the lifting rack of FIG. 8.
Figure 10:
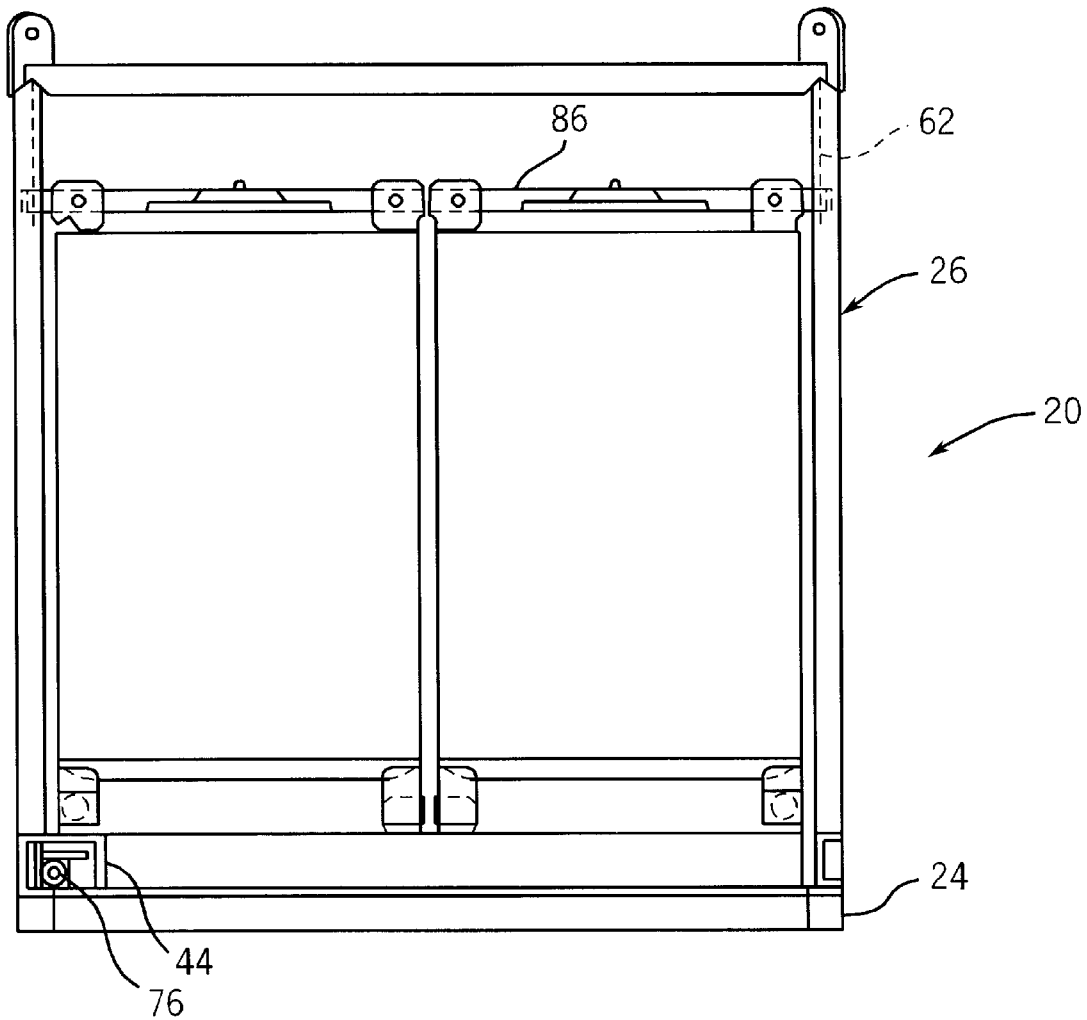
FIG. 10 is a side elevation view of the lifting rack of FIG. 8.

The manifold 70 is built in to the base 24, as shown in FIGS. 6 and 7. Particularly, the pipe 72 is received within an inwardly-opening U-shaped channel, see 84 typically, of the I-beam rails. As such, the valve 76 is positioned under the valve guard 44 and the pipe 72 then continues within the front longitudinal rail 38, then the first lateral rail 34 and finally into the rear longitudinal rail 32. The position of the tees 80 and length of each transfer hose assembly 78 are selected according to location of the IBC discharge valve 66. Particularly, the disconnect 82 is adapted to provide a quick-connect coupling with the discharge valve 66 as shown in FIG. 11.

Referring to FIGS. 8–11, the lifting rack 20 is shown supporting an IBC 22 in each of the four rectangular support areas 38-x. The four IBCs are removably secured to the lifting rack 20 by a pair of rods 86. Each rod 86 extends between the plates 62 and passes through the opening 64.

Each rod 86 is a 1-inch diameter S/80 steel pipe. The rods 86 are pinned on their ends, as at 88, using clevis pins and cotter pins, to retain the rods 86 in place.

Using the rack 20, as described, each IBC 22 can be loaded in the lifting rack 20 from the side or from the top. After the IBCs are loaded, the rods 86 are inserted through the plate opening 64 and pinned as at 88. Thus, the rods 86 lock the IBCs 22 into place.

As is apparent, the rack 20 could support anywhere from one to four IBCs 22. Advantageously, the rack 20 supports at least two IBCs 22. In the illustrated embodiment of the invention, the rack 20 is 10 feet long by 8 feet wide and 8 to 9 feet high. However, the precise dimensions would depend on the size of the IBCs 22 to be transported. Assuming 550-gallon EBCs, the lifting rack is advantageously intended to handle fluid amounts in the range of 1100 to 2200 gallons, The lifting rack 20 uses the same dimensions as ISO units and can be made with tandem locks on trucks and ships.

By using four separate IBCs, the rack 20 can handle four different liquid products with up to 550 gallons each. Each IBC 22 can become pumped separate from the others using the manifold 70. This can be controlled by selectively opening or closing the valve 66 associated with the individual IBCs 22 and the manifold discharge valve 76. The manifold system 70 is protected by the base 24. Likewise, individual IBCs can be removed or replaced for individual cleaning and/or filling.

What is claimed is:

1. A lifting rack for supporting plural intermediate bulk containers (IBCs) for transporting and storing materials, comprising:

a base including opposite longitudinal rails connected between plural laterally extending rails to define a support surface having plural independent rectangular support areas each to support an IBC, in use and adapted to prevent lateral and longitudinal movement of each IBC, in use;

a frame secured to and extending upwardly from the base, the frame including plural posts secured to the rails proximate outside corners of each of the rectangular support areas and a pair of longitudinal bars and lateral bars secured to one another at each corner, in a rectangular configuration, and secured to tops of the posts; and lifting means for engagement by a transport device for lifting the rack.

2. The lifting rack of claim 1 wherein the lifting means comprises plural lifting lugs secured to the bars proximate each corner.

3. The lifting rack of claim 1 wherein the lifting means comprises runners secured to an underside of the base to define a space for lifting with a forklift.

4. The lifting rack of claim 1 wherein the rails comprise I-beam rails.

5. The lifting rack of claim 1 wherein the base further comprises a planar pad secured to the rails proximate each corner of the rectangular support areas.

6. The lifting rack of claim 1 wherein the base further comprises an L-bracket secured to and extending upwardly from the rails proximate each corner of the rectangular support areas.

7. The lifting rack of claim 1 wherein the bars comprise tubular bars.

8. The lifting rack of claim 1 wherein the posts comprise tubular posts.

9. The lifting rack of claim 1 further comprising means for removably securing an IBC on each of the rectangular support areas, in use.

10. The lifting rack of claim 9 wherein the removably securing means comprises an elongate rod passing through openings in opposite plates secured to the frame.

11. A lifting rack for supporting plural intermediate bulk containers (IBCs) for transporting and storing materials, comprising:

a base including opposite longitudinal rails connected between plural laterally extending rails to define a support surface having plural rectangular support areas each to support an IBC, in use;

a frame secured to and extending upwardly from the base, the frame including plural posts secured to the rails proximate outside corners of each of the rectangular support areas and a pair of longitudinal bars and lateral bars secured to one another at each corner, in a rectangular configuration, and secured to tops of the posts;

lifting means for engagement by a transport device for lifting the rack; and a manifold received in the base for connecting to plural IBCs, in use.

12. The lifting rack of claim 11 wherein the manifold includes a quick coupler for each rectangular support area and an outlet valve.

13. A lifting rack for supporting up to four intermediate bulk containers (IBCs) for transporting and storing materials, comprising:

a steel base including three longitudinal rails connected between three laterally extending rails to define a support surface having four independent rectangular support areas each to support an IBC, in use and adapted to prevent lateral and longitudinal movement of each IBC, in use;

a steel frame secured to and extending upwardly from the base, the frame including four corner posts and two central posts secured to the rails proximate outside corners of each of the rectangular support areas and a pair of longitudinal bars and lateral bars secured to one another at each corner, in a rectangular configuration, and secured to tops of the posts; and lifting means for engagement by a transport device for lifting the rack.

14. The lifting rack of claim 13 wherein the lifting means comprises plural lifting lugs secured to the bars proximate each corner.

15. The lifting rack of claim 13 wherein the lifting means comprises runners secured to an underside of the base to define a space for lifting with a forklift.

16. The lifting rack of claim 13 wherein the rails comprise I-beam rails.

17. The lifting rack of claim 13 wherein the base further comprises a planar pad secured to the rails proximate each corner of the rectangular support areas.

18. The lifting rack of claim 13 wherein the base further comprises an L-bracket secured to and extending upwardly from the rails proximate each corner of the rectangular support areas.

19. The lifting rack of claim 13 wherein the bars comprise tubular bars.

20. The lifting rack of claim 13 wherein the posts comprise tubular posts.

21. The lifting rack of claim 13 further comprising means for removably securing an IBC on each of the rectangular support areas, in use.

22. The lifting rack of claim 21 wherein the removably securing means comprises an elongate rod passing through openings in opposite plates secured to the frame.

23. A lifting rack for supporting up to four intermediate bulk containers (IBCs) for transporting and storing materials, comprising:

a steel base including three longitudinal rails connected between three laterally extending rails to define a support surface having four rectangular support areas each to support an IBC, in use;

a steel frame secured to and extending upwardly from the base, the frame including four corner posts and two central posts secured to the rails proximate outside corners of each of the rectangular support areas and a pair of longitudinal bars and lateral bars secured to one another at each corner, in a rectangular configuration, and secured to tops of the posts; and lifting means for engagement by a transport device for lifting the rack; and a manifold received in the base for connecting to plural IBCs, in use.

24. The lifting rack of claim 23 wherein the manifold includes a quick coupler for each rectangular support area and an outlet valve.

25. A lifting rack for supporting plural intermediate bulk containers (IBCs) for transporting and storing materials, comprising:

a base including opposite longitudinal rails connected between plural laterally extending rails to define a support surface having plural rectangular support areas each to support an IBC, in use;

a frame secured to and extending upwardly from the base, the frame including plural posts secured to the rails proximate outside corners of each of the rectangular support areas and a pair of longitudinal bars and lateral bars secured to one another at each corner, in a rectangular configuration, and secured to tops of the posts; and lifting means for engagement by a transport device for lifting the rack; and a ladder secured to the frame.

26. A lifting rack for supporting up to four intermediate bulk containers (IBCs) for transporting and storing materials, comprising:

a steel base including three longitudinal rails connected between three laterally extending rails to define a support surface having four rectangular support areas each to support an IBC, in use;

a steel frame secured to and extending upwardly from the base, the frame including four corner posts and two central posts secured to the rails proximate outside corners of each of the rectangular support areas and a pair of longitudinal bars and lateral bars secured to one another at each corner, in a rectangular configuration, and secured to tops of the posts; and lifting means for engagement by a transport device for lifting the rack; and a steel ladder secured to the frame.

27. The lifting rack of claim 26 wherein the ladder is secured to one of the central posts.

* * * * *